US006200218B1

(12) United States Patent
Lindsay

(10) Patent No.: US 6,200,218 B1
(45) Date of Patent: Mar. 13, 2001

(54) GAMING CHIP SYSTEM

(75) Inventor: Jeffrey Paul Lindsay, London (GB)

(73) Assignee: John Huxley Limited (GB)

( * ) Notice: Subject to any disclaimer, the term of this patent is extended or adjusted under 35 U.S.C. 154(b) by 0 days.

(21) Appl. No.: 09/009,516

(22) Filed: Jan. 20, 1998

(30) Foreign Application Priority Data

Mar. 27, 1997 (GB) ..... 9706694

(51) Int. Cl.[7] ..... A63F 9/24
(52) U.S. Cl. ..... 463/25; 463/47; 273/148 R
(58) Field of Search ..... 194/213–214; 273/148 R; 902/23, 25, 26, 41; 463/16, 47, 48, 25, 30

(56) References Cited

U.S. PATENT DOCUMENTS

| | | | | |
|---|---|---|---|---|
| 3,936,054 | * | 2/1976 | Garcia | 273/134 |
| 4,755,941 | * | 7/1988 | Bacchi | 364/412 |
| 4,882,473 | * | 11/1989 | Bergeron et al. | 235/380 |
| 5,103,081 | * | 4/1992 | Fisher et al. | 235/464 |
| 5,166,502 | * | 11/1992 | Rendleman et al. | 235/492 |
| 5,179,517 | * | 1/1993 | Sarbin et al. | 364/410 |
| 5,216,234 | * | 6/1993 | Bell | 235/464 |
| 5,429,361 | * | 7/1995 | Raven et al. | 273/138 R |
| 5,470,079 | * | 11/1995 | LeStrange et al. | 273/138 A |
| 5,580,310 | * | 12/1996 | Orus et al. | 463/16 |
| 5,676,376 | * | 10/1997 | Valley | 273/288 |
| 5,735,742 | * | 4/1998 | French | 463/25 |
| 5,781,647 | * | 7/1998 | Fishbine et al. | 382/1 |
| 5,895,321 | * | 4/1999 | Gassies et al. | 463/29 |

FOREIGN PATENT DOCUMENTS

| | | |
|---|---|---|
| 37663585 | 10/1986 | (AU) . |
| 42 40 886 A1 | 7/1994 | (DE) . |
| 0455315A2 | 11/1991 | (EP) . |

* cited by examiner

*Primary Examiner*—Michael O'Neill
*Assistant Examiner*—Carmen White
(74) *Attorney, Agent, or Firm*—Gottlieb, Rackman & Reisman, Inc.

(57) ABSTRACT

A gaming chip system for evaluating a collection of gaming chips, represents different gaming chips and assigns monetary values to each of the different gaming chips. A display displays the assigned monetary value of each gaming chip. The total value of a collection of chips is evaluated by counting the number of chips for each type, and calculating the monetary value of each gaming chip type using the assigned monetary value.

22 Claims, 1 Drawing Sheet

GAMING CHIP SYSTEM

INTRODUCTION AND BACKGROUND

The present invention relates to gaming and in particular to handling and evaluating gaming chips.

The invention is primarily intended for use on casino floors with table games which involve the use of a mixture of different types of gaming chip. Typically, each different type of gaming chip is pre-assigned a certain monetary value and the chips are distinguished by shape and/or colour. However, it is also known to use chips which are assigned to a particular player and are given a certain value at the start of the game. Thus a player may elect to use chips of a particular colour and shape and have a particular value assigned to them. He may also chose to change the value during the game. It is often necessary between or during the course of such games to have a quick and easy way of evaluating the use of the gaming chips.

SUMMARY OF THE INVENTION

In a first aspect, the invention provides a gaming chip system for indicating the value of gaming chips. Different chips are represented and assigned a monetary value, which is then displayed.

In a second aspect, the invention provides a gaming chip system for evaluating a collection of gaming chips. Means is provided for representing a plurality of different gaming chips, and means for assigning monetary values to each of the different gaming chips. A display displays the assigned monetary value of each gaming chip and evaluating means counts the number of chips for each type, and calculates the monetary value of each gaming chip type using monetary values assigned by the assigning means.

The present invention provides a quick and simple way of assigning values to the different gaming chips. The different types of gaming chip may be represented by the system in a number of different ways. A particularly convenient way of representing the gaming chips is provided if the different types of gaming chip can be attached to the gaming system. Therefore, it is preferable if the means for representing a plurality of gaming chips comprises means for attaching a plurality of different gaming chips to the gaming system. This has the advantage, that the gaming system can be used with a variety of different gaming chips. Hence, the gaming system may be used with many different varieties of gaming chip.

It is also preferably if both the players and a game supervisor can read the values assigned to the different types of gaming chip. Therefore, it is preferably if the means for representing a plurality of different gaming chips provides a double sided display. Similarly, it is preferable if the first display means are double sided.

The values assigned to each different type of gaming chip are displayed by the first display means. These are located in the vicinity of the representation of the gaming chip to which they correspond. It is preferably that the first display means displays alpha numeric characters. Therefore, the first display mean may be used to display either the value assigned to each different gaming chip or the status of each gaming chip. For example, the first display means may be used to indicate if a gaming chip is free for selection by a player or if it is already in use.

A monetary value may be assigned to a chip in a number of ways. In many table games, it is preferable if the different types of gaming chip can only take on a certain value from a predetermined range. For example, in Britain, the values may be 25p, 50p, £1, £2, £2.50, £5, £10, £20, £50. Therefore, it is preferable if means are provided for incrementing the assigned monetary value through a range of predetermined values. The values are incremented in ranges according to the country of installation The gaming chip system may be used with other components on a casino floor. Therefore, it is preferable if communication means are provided so that the assigned monetary value of a particular chip can be communicated to another component. For example, a component which validates the choice of assigned monetary value.

At the end of a game or sequence of games, the assigned monetary values may need to be reset. This can be conveniently done if a clear button is provided which clears all of the assigned monetary values. Therefore, it is preferable if the system further comprises means for clearing or zeroing the assigned monetary values of each of the different gaming chips and indicate that they are available for use. It is also preferable if this clear button when pressed allows the communication means to transmit a signal to another component to clear or zero all values previously communicating to the other component by the gaming system.

The use of the gaming system is regulated by a supervisor. To avoid players changing the assigned values while the supervisor is distracted, it is preferable if the gaming system further comprises security means. The security means can be simply implemented by providing a switch which disables the means to assigned monetary values. The switch, can only be operated by the supervisor. In order to show whether or not the security means are switched on or off, it is preferable to have a security indicator e.g. a light, which indicates when the assigned values may be changed. It is also preferable of the security status can be communicated to another component e.g. a validation system.

DESCRIPTION OF THE PREFERRED EMBODIMENTS

Figure 1:
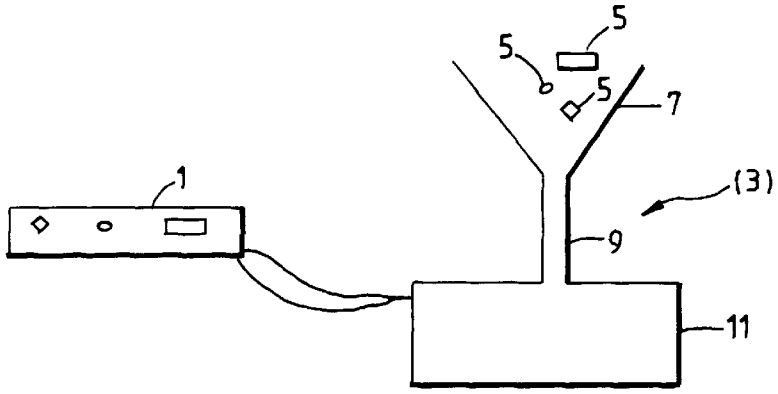
FIG. 1, is a schematic diagram of a gaming chip system according to the present invention.

An arrangement for the gaming chip system is shown in FIG. 1. The gaming chip system comprises an indicator 1 which is in electrical contact with a gaming chip collector 3. The indicator 1, will be described in more detail later in relation to FIG. 2. A mixture of gaming chips 5, is shown entering the opening 7 of the gaming chip collector 3. The mixture of gaming chips 5 enters the gaming chip collector 3 and falls to the base 11. The gaming chip collector 3, is shown with a long narrow opening channel 9. This is to prevent extraction of the gaming chips from the gaming chip collector by unauthorised personnel. Once the gaming chips 5 are within the gaming chip collector 3 they are sorted, counted and then evaluated using information derived from the indicator 1. Such collectors for sorting and counting gaming chips are known per se.

Figure 2:
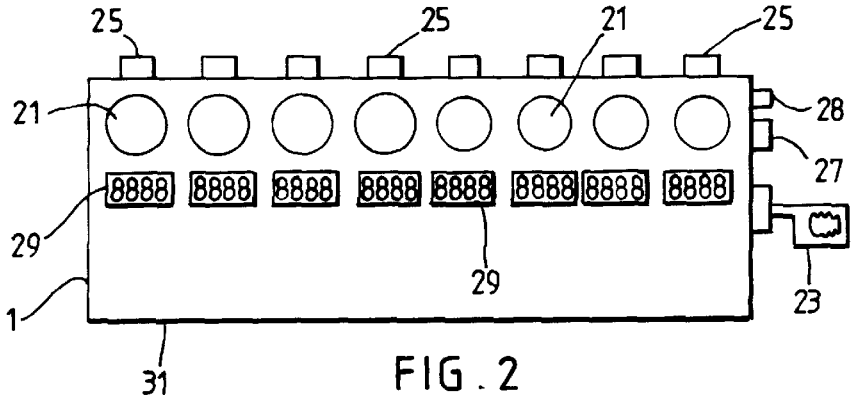
FIG. 2, is a diagram of an indicator of the present invention.

FIG. 2, shows an indicator 1 according to the present invention. On the front surface 31 of the indicator 1, there is provided both means to a represent the different types of gaming chip 21 and display means 29 to display the values assigned to each of the different gaming chips. In the embodiment shown here, a plurality of different types of gaming chip may be attached to the front surface 31 of the indicator 1 via the means to represent the different types of gaming chip 21. The attached gaming chips are located above the display means 29, such that the value assigned to each gaming chip is clearly displayed below each type of gaming chip displayed.

Value change buttons 25 are located on the top surface 33 of the indicator 1 to assign a value to each of the different gaming chips. One button 25 is provided for each different gaming chip displayed. Each value change button 25 is located directly above each of the different types of gaming chips displayed. Pressing the button 25 once results in the assigned value of the chip being incremented by a predetermined value. For example, the chips may only be able to take a series of values, 25p, 50p, £1.00, £2.00, £5.00, £10.00, £20.00, £50.00 etc. Each time one of the buttons 25 is pressed the assigned value increments to the next value in the series.

On the right hand side 35 of the indicator 2 there is provided a security key 23. Located above the security key there is a clear button 27. A security light 28 is located above the clear button. The function of the security key 23 and the security light 28 will be discussed later. The clear button 27 forms part of the means to assign values to each of the gaming chips. When the clear button 27 is pressed, the values assigned to each of the different gaming chips is set back to zero and each of the value indicators display '----'.

The security key 23 is present to prevent a person who is not authorised changing the monetary values assigned to each of the different chips. When the key is turned to the locked position the value change buttons 25 cannot be used to change the assigned monetary values i.e. the values are locked. In the locked position, the key can be removed from the indicator. The security light 28 is lit when the values are locked.

Figure 3:
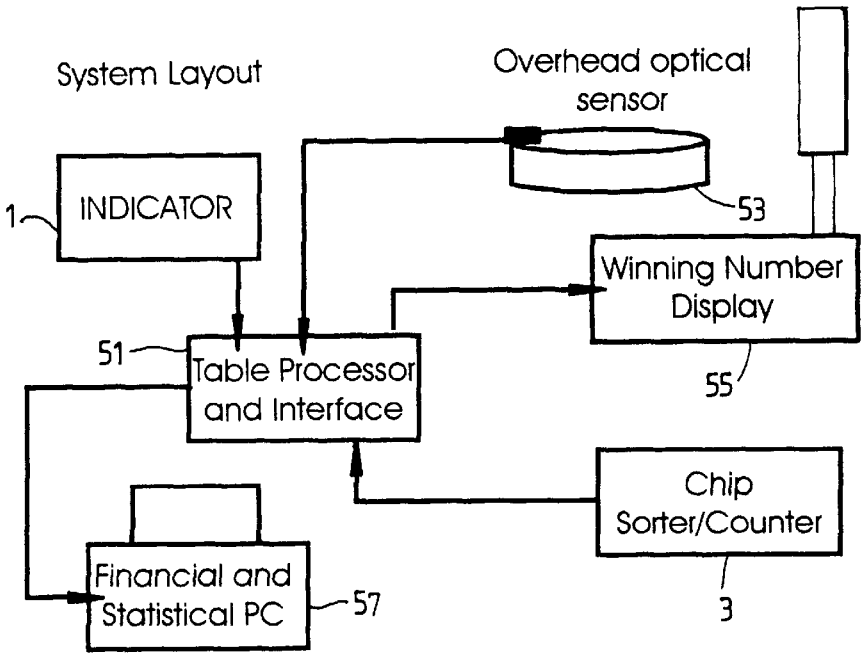
FIG. 3, is a schematic diagram showing the integration of the present invention with other components used on a casino floor.

FIG. 3 shows the indicator 1 and collecting means 3 of the present invention integrated with a number of components which may be used on a casino floor for roulette. The indicator 1 and the chip counter 5 are connected via interface 51. Also connected to the system via the interface 51 are an overhead optical sensor 53, winning number display apparatus 55 and a financial and statistical computer (PC) 57.

The indicator 1 of the system is connected to the financial and statistical PC 57 via the Interface 51. One of the many function of the PC is to validate the monetary value of each type of gaming chip set by the indicator 1. Each of the assigned monetary values is communicated from the indicator 1 via its communications port and the interface 51 to the PC 57. The PC 57 can then allow or disallow the required assigned monetary value. Therefore, the range of possible monetary vales for each of the different types of gaming chips can be further restricted. The indicator 1 can also transmit information about its security status via its communications port to the PC.

The chip counter 3, also transmits information via the interface to the PC 57. The chip collector 3 sorts and counts the collection of gaming chips which it holds. The PC provides display means to display this information if required. The PC further keeps a check on the different types of chips counted and can use this information to restrict the monetary values assigned by the indicator 1.

FIG. 3, shows the present invention connected to a table game. The overhead optical sensor 53 functions to read the winning number from a roulette wheel and inputs the data into the interface 51. The interface then outputs the winning number to the winning number display apparatus 55. The data received from the sensor 53 along with the chip collector allows a supervisor to quickly check the financial gain or loss of the table as a while or the amount staked using particular chips, and hence by an individual player, during a game.

In light of this disclosure, modifications of the described embodiment, as well as other embodiments, all within the scope of the present invention defined by the appended claims, will now become apparent to a person skilled in the art.

What is claimed is:

1. A gaming chip value indicator for location at a gaming table to indicate the value of gaming chips in use at the table, the indicator comprising:

a representation means for indication each type of a plurality of different gaming chip types in use at the table;

an assignor means for assigning a value to each type of gaming chip, the assignor means being operated by a user to select the assigned value, the assigned value for a chip type being the same or different to the assigned value for one or more other chip types and the assigned value being changeable by the user;

and a display to display the assigned value of a chip type in association with the representation of the chip type.

2. A gaming chip value indicator according to claim 1, wherein the display displays alpha-numeric characters.

3. A gaming chip value indicator according to claim 1, wherein the display displays a numerical value.

4. A gaming chip value indicator according to claim 1, wherein the assignor means assigns a value selected from a predetermined set of values.

5. A gaming chip value indicator according to claim 1, wherein the display displays a status of a represented gaming chip.

6. A gaming chip value indicator according to claim 1, wherein the assignor means comprises individual assignors and a master assignor, wherein the master assignor overrides the individual assignors.

7. A gaming chip value indicator according to claim 6, wherein the master assignor fixes a minimum value to be assigned by the individual assignors.

8. A gaming chip value indicator according to claim 6, wherein the master assignor resets all of the values assigned by the individual assignors to predetermined values.

9. A gaming clip value indicator according to claim 1 wherein the representations represent the different gaming chips by different colours.

10. A gaming chip value indicator according to claim 1, wherein the representations represent the different gaming chips by different shapes.

11. A gaming chip system for evaluating a collection of gaming chips, comprising:

a representation means for indicating each of a plurality of different types of gaming chips;

an assignor means operable by a user for selecting and assigning a monetary value to each of the different gaming chip types represented, the monetary value being selectable and changeable by the user;

a first display to display the assigned monetary value in association with a respective gaming chip type representation;

an evaluator having a receiver to receive a mixture of gaming chips of each type;

a counter to count the number of chips of each type;

and a calculator to calculate the monetary value of each gaming chip type using the assigned monetary values assigned by the assignor means.

12. A gaming chip system according to claim 11, wherein the assignor means comprises an incrementor to increment the assigned monetary value by predetermined intervals.

13. A gaming chip system according to claim 11, further comprising a clearer to clear the assigned monetary values of each of the different gaming chips.

14. A gaming chip system according to claim 11, further comprising a communicator to communicate the assigned monetary values to an external component.

15. A gaming chip system according to claim 11, further comprising a security device which, when operational, disables the assignor means.

16. A gaming chip system according to claim 15, wherein the security device communicates the status of the security device to an external component.

17. A gaming chip system according to claims 15, wherein the security device further comprises an indicator to indicate the status of the security means.

18. A gaming chip system according to claim 11, wherein the representations comprise gaming chips attached to the gaming system.

19. A gaming chip system according to claim 11, wherein the system further comprises a second display to indicate the total monetary value of the mixture of gaming chips.

20. A gaming chip system according to claim 11, wherein the first display displays alpha-numeric characters.

21. A gaming chip system according to claim 11, wherein the first display displays a numerical value.

22. A gaming chip system according to claim 11, wherein the first display displays a status of a represented gaming chip.

* * * * *